United States Patent [19]

Swarth

[11] 4,330,936

[45] May 25, 1982

[54] COMPRESSED TABLET-SPLITTING HOLDER

[76] Inventor: Oscar S. Swarth, 25-30 163rd St., Flushing, N.Y. 11358

[21] Appl. No.: 236,746

[22] Filed: Feb. 23, 1981

[51] Int. Cl.[3] ..... B26B 17/00

[52] U.S. Cl. ..... 30/124; 81/43; 225/103; 269/275

[58] Field of Search ..... 81/43; 294/99 R, 99 S, 294/100; 238/354; 269/275; 225/103; 30/124

[56] References Cited

U.S. PATENT DOCUMENTS

| | | | |
|---|---|---|---|
| 1,011,597 | 12/1911 | Fischler | 81/43 |
| 1,782,615 | 11/1930 | Hopwood | 269/275 |
| 1,847,401 | 3/1932 | Klein | 132/148 |
| 3,306,139 | 2/1967 | Brackett | 81/43 |
| 3,477,707 | 11/1969 | Pfeffer | 269/275 |
| 3,487,524 | 1/1970 | Filia | 269/275 |
| 3,815,609 | 6/1974 | Chester | 81/43 |
| 3,906,957 | 9/1975 | Weston | 128/354 |
| 4,126,962 | 11/1978 | Polcaro | 294/99 R |
| 4,173,826 | 11/1979 | Leopold et al. | 30/124 |

FOREIGN PATENT DOCUMENTS

| | | | |
|---|---|---|---|
| 2455114 | 5/1976 | Fed. Rep. of Germany | 81/43 |

*Primary Examiner*—Paul J. Hirsch

[57] ABSTRACT

A holder enabling the user to easily and accurately split compressed medical tablets into equal halves having blunt, specifically curved steel jaws to which are permanently affixed resilient rubber cushioning pads, a means for securely holding compressed tablets of all shapes and sizes by means of the thumb and forefinger and to effect splitting by exerting a flexing force appropriately damped along a line which is congruent to the axis of said jaws of the device, a means to preserve the cohesion of the tablet's granulation so that after splitting, each half of the tablet will maintain its original state.

2 Claims, 6 Drawing Figures

COMPRESSED TABLET-SPLITTING HOLDER

BACKGROUND OF THE INVENTION

A physician may prescribe that his patient take one or more compressed tablets of medication so many times a day and quite commonly may prescribe that each dosage consist of one-half tablet as the patient's correct dose each time. Some tablets are scored in order to permit them to be divided evenly and others are not. However, frequently even tablets which have been scored are difficult, if not impossible to break evenly by use of the fingers alone and often those which are not scored are nearly impossible to divide evenly even if one uses a knife, cutting board or other shearing device.

A number of tablet splitting devices have been proposed to solve this problem. Such devices incorporate a tablet splitting wedge or knife edge and some means for holding the tablet so that when the knife edge is brought compressively against either the surfaces of a tablet or its outer edge, even splitting is supposed to occur. Devices of this type may be seen in U.S. Pat. Nos. 3,517,871, 4,173,826 and 4,179,806. However, these devices do not provide a complete solution to the problem for the reason that their cutting forces applied to the tablet are harsh, un-damped and concentrated only upon an isolated, single point of the tablet. For example, regardless of how a tablet may be held, the application of an un-damped splitting force applied from either one or both sides of a tablet induces a shock-like effect within the tablet granulation and causes the tablet to break apart unevenly or for that matter cannot assure that the tablet may not disintegrate into several dissimilar smaller parts. Since tablets are invariably provided with convex curved upper and lower surfaces, the knife edge (unless it is shaped to match such curvature) will apply a single point pressure at some point upon the curved surface of the tablet. This is totally unsatisfactory and will produce fractures which are not aligned with the cutting edge of the knife. The foregoing effect is exacerbated by the fact that the granulation of solid dry material comprising tablets are held together by only moderate cohesive action and invariably disintegrate when subjected to the un-damped compressive force exerted by the knife edge whether or not this force is applied either to one or both surfaces of the tablet, or to the tablet's outer edges.

The present invention has uniquely provided a solution to the foregoing problems as will be seen with reference to the specification and drawing which follows:

SUMMARY OF THE INVENTION

In accordance with the present invention, a compressed tablet-splitting holder is disclosed comprising two jaws having opposed clamping surfaces to which are affixed elastic resilient pads to provide a damping effect, means for moving said jaws and surfaces toward each other to bring said opposing surfaces so that they may contact each other, such that during this action of movement of said jaws toward each other a tablet will be cradled by said elastic resilient members between said jaws effecting firm contact between opposite surfaces of said tablet securely held across the major diameter of said tablet at its nominal midpoint. When clamped and firmly held by said jaws in this fashion, the free unheld half of the tablet may then easily be split away by use of the thumb and forefinger of the opposite hand. Since both halves of said tablet are cradled by the elastic resilient members affixed to the inner surfaces of both jaws and the resilience of the flesh of thumb and forefinger of the opposing hand, compressive forces which divide the tablet are damped to prevent erratic fracturing or complete disintegration of the tablet while it is being split in half.

DESCRIPTION OF A PARTICULAR EMBODIMENT

Figure 1:
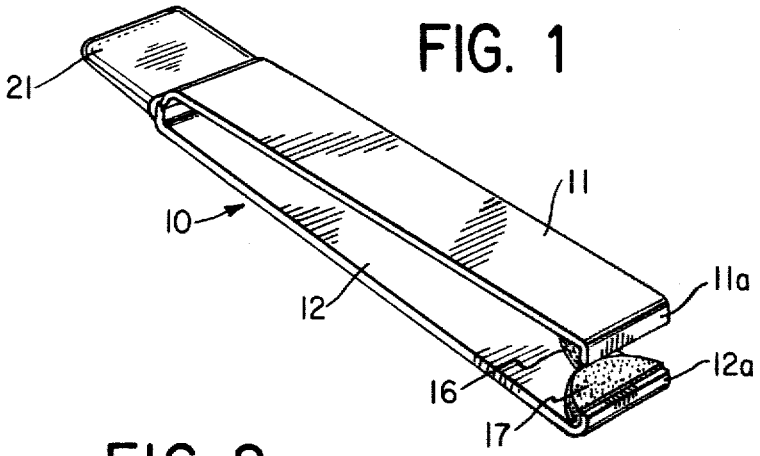
FIG. 1 is a view in perspective of the compressed tablet-splitting holding device constructed in accordance with the principles of the present invention.
Figure 2:
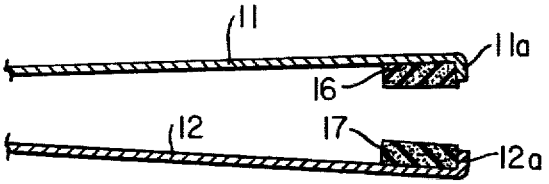
FIG. 2 is a partial side cross sectional view of the device of FIG. 1 with the gripping means in position for reception of a compressed tablet.

Referring now to the drawing and initially to FIGS. 1 and 2 thereof, the form of tablet splitting holder constructed according to the principles of the present invention has been illustrated. The device includes arms 11 and 12 of spring steel or other similar material which are attached to each other at the base 19 and enclosed in a plastic cover. It will be understood that the flexibility of the steel or the material forming the arms 11 and 12 and the base 19 permit arms 11 and 12 to be grasped between the thumb and forefinger of the user and to be moved toward each other while in the absence of such movement, the arms will normally assume the position shown in FIGS. 1 and 2. Each of the arms 11 and 12 has at its free end jaws 11*a* and 12*a* respectively which are bent or curved at 90° to the long axis of arms 11 and 12 and directed inwardly, that is toward the opposing arms and in direct alignment with its opposing jaw. Furthermore, to the inner surfaces of jaws 11*a* and 12*a* are pads 16 and 17 affixed by adhesive, and as indicated in FIG. 2, the inner facing surfaces of pads 16 and 17 extend more closely to each other than do the edges of the blunt surfaces of steel jaws 11*a* and 12*a* when both arms 11 and 12 are moved toward each other by squeezing between the thumb and forefinger.

Figure 3:
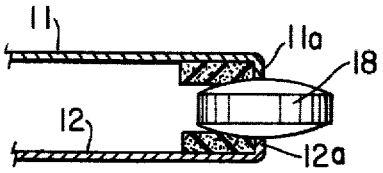
FIG. 3 is a view similar to FIG. 2 showing the operation of the device holding a tablet at its approximate midpoint and illustrates how the shape of each of its bent jaws limits a dimensional change in the elastic resilient members while they are compressed against both the upper and lower surfaces of the tablet so that the density of the resilient members are raised across the nominal midpoint of the tablet to be split in half.
Figure 4:
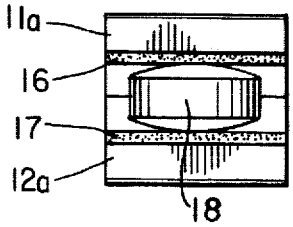
FIGS. 4–6 illustrate the typical sequence in which a tablet is placed first up to its midpoint within the device constructed according to the invention and thereafter held resiliently and firmly therein while its protruding half may be bent or split away from the jaws and divided into equal halves without disintegration.
Figure 5:
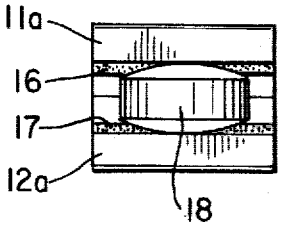
Figure 6:
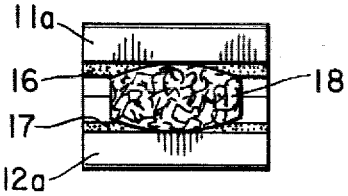

Referring to FIG. 3 and the sequence according to FIGS. 4–6, the reason for the aforementioned relationship is apparent. When the device is intended for use, a tablet is first placed between jaws 11*a* and 12*a*. Then, with increased finger pressure the opposite surfaces of the elastic resilient members are brought into full engagement with the upper and lower surfaces of the tablet 18. As seen in FIGS. 4–6, both sides of tablet 18 are cradled by and enveloped by the elastic cushions 16 and 17 and securely held in a fully damped firm grip, and in this position the tablet's free and un-held portion may be grasped by the thumb and forefinger of the opposing hand and bent or broken away along the fulcrum-like line described by jaws 11*a* and 12*a* of the device without other breakage or multiple fractures. Furthermore, of considerable importance is the fact that the elastic resilient members 16 and 17 when moved toward each other readily conform to a tablet with either a flat or curved contour so that the tablet is securely restrained from moving when a splitting stress is applied to its free un-held portion. Because of the variable contours with which different compressed tablets are made, clamping such tablets in the absence of elastic members 16 and 17 would occur only at the raised center of a tablet and therefore the compressive force applied in an un-damped fashion causes numerous fractures of the tablet or even its complete disintegration. Furthermore, the retained half of the split tablet will be securely held by the elastic resilient pads 16 and 17 until finger pressure is released.

It will be understood that the foregoing description has been of particular embodiments of the invention and is therefore representative. In order to understand more fully the scope of the invention, reference should be made to the appended claims.

I claim:

1. A device for securely holding compressed tablets so that they may easily and accurately be divided into equal halves comprising two jaws having opposed laterally extending in-line uninterrupted surfaces, each of said surfaces lying in a plane along the lateral extent of jaws, means for moving said jaws and said surfaces toward each other, resilient members carried by each of said jaws and mounted adjacent to said opposed surfaces, a portion of each resilient member extending toward the other resilient member for a greater distance than the adjacent surface extends toward the opposed surface of each jaw, a tablet being adapted to be held between said jaws with a part of the tablet extending inwardly of said jaws and the remainder thereof extending outwardly of said jaws, such that during an initial movement of said jaws toward each other, the inwardly extending part of said tablet is held between said jaws while being cradled by said extending portions of each resilient member, further movement of said jaws effecting compression of said resilient members about said tablet and retention of said tablet by said resilient members between said opposed surfaces whereby the part of said tablet extending outwardly from said jaws may be grasped and the tablet may be split into said inwardly and outwardly extending parts, wherein said means for moving said jaws toward each other comprises flat spring-like arm, said jaws comprising integral end portions of said arms bent toward each other.

2. The device according to claim 1 wherein said jaws form portions bent toward each other at a 90° angle and the resilient members are restrained during compression by said portions such that the resilient members form a line of greater density along the inner edge of said jaws which acts as a fulcrum to assist in even splitting of the tablet.

* * * * *